US009091279B2

(12) United States Patent
Cui

(10) Patent No.: US 9,091,279 B2
(45) Date of Patent: Jul. 28, 2015

(54) AIR MOVER

(75) Inventor: Hedi Cui, Guangdong (CN)

(73) Assignee: FOSHAN NAIBAO ELECTRIC CO., LTD., Foshan, Guangdong (CN)

( * ) Notice: Subject to any disclaimer, the term of this patent is extended or adjusted under 35 U.S.C. 154(b) by 907 days.

(21) Appl. No.: 13/373,854

(22) Filed: Dec. 2, 2011

(65) Prior Publication Data

US 2012/0141264 A1 Jun. 7, 2012

(30) Foreign Application Priority Data

Dec. 2, 2010 (CN) ..... 2010 2 0640221 U

(51) Int. Cl.

| | |
|---|---|
| ***F04D 29/62*** | (2006.01) |
| ***F04D 17/10*** | (2006.01) |
| ***F04D 25/08*** | (2006.01) |
| ***F04D 29/28*** | (2006.01) |
| *F04D 29/44* | (2006.01) |

(52) U.S. Cl.

CPC ..... *F04D 29/626* (2013.01); *F04D 17/105* (2013.01); *F04D 25/08* (2013.01); *F04D 29/282* (2013.01); *F04D 29/441* (2013.01)

(58) Field of Classification Search

CPC ..... F04D 17/105; F04D 25/08; F04D 29/282; F04D 29/626; F04D 29/603; F04D 29/602; F04D 29/441

USPC ..... 417/234, 326, 423.1, 423.14, 423.15, 417/360, 313, 423.9, 363

See application file for complete search history.

(56) References Cited

U.S. PATENT DOCUMENTS

| | | | | |
|---|---|---|---|---|
| 2,931,562 | A * | 4/1960 | Wistrand | 417/363 |
| 3,775,029 | A * | 11/1973 | Ranz | 417/353 |
| 5,030,068 | A * | 7/1991 | Jacobs et al. | 417/363 |
| 5,035,398 | A * | 7/1991 | Chiang | 248/674 |
| 5,257,904 | A * | 11/1993 | Sullivan | 415/214.1 |
| 5,862,037 | A * | 1/1999 | Behl | 361/679.49 |
| 6,739,070 | B1 * | 5/2004 | Jacobs et al. | 34/90 |
| 7,108,478 | B2 * | 9/2006 | Hancock | 415/108 |
| 2006/0193722 | A1 * | 8/2006 | Butler et al. | 415/206 |

* cited by examiner

*Primary Examiner* — Devon Kramer
*Assistant Examiner* — Joseph Herrmann
(74) *Attorney, Agent, or Firm* — Raymond Y. Chan; David and Raymond Patent Firm

(57) ABSTRACT

An air mover includes a housing and an air stream generator. The housing includes an air exit, a first housing body and a second housing body symmetrical to the first housing body in size, wherein the first housing body has an perforated end panel formed at an outer side thereof. The air stream generator includes a motor coupled at an interior side of the end panel of the first housing body via a locking mechanism and a impeller being powered by the motor to generate an air stream exiting at the air exit. The locking mechanism is securely locked up the motor at the end panel of the first housing body from an exterior side of the end panel such that the motor is securely supported at the end panel of the first housing within the housing cavity.

15 Claims, 10 Drawing Sheets

AIR MOVER

BACKGROUND OF THE PRESENT INVENTION

1. Field of Invention

The present invention relates to an air mover, and more particularly to an air mover which comprises a motor being easily assembled in a housing and being securely retained in the casing to minimize any unwanted vibration of the motor.

2. Description of Related Arts

A conventional air mover, which is adapted for drying surface and moving musty air, comprises an outer casing, a motor received in the outer casing, and a fan blade powered by the motor, wherein the outer casing has two side openings defining as two air inlets respectively and an air exit provided at a bottom portion of the outer casing. Therefore, when the fan blade is driven to rotate to generate a suction effect within the outer casing, air is sucked into the outer casing through the air inlets and is blown out through the air outlet. Generally speaking, the conventional air mover has several drawbacks.

The outer casing is configured to have a one single integrated structure to receive the motor therein. The manufacturing cost of the outer casing will be relatively high to precisely fit the motor therein. However, the outer casing is hard to modify the air flow configuration in order to minimize the noise generated by the air suction effect. In other words, the uneven or rough inner surface of the outer casing will create an unavoidable noise and air resistance to reduce the efficiency of the air flow configuration of the fan blade.

The motor can be mounted within the outer casing by welding. However, the motor installation will be complicated and will highly increased the installation cost of the air mover. The overall weight of the air mover will be highly increased as well. In addition, heat will be generated by the motor to distort the shape of the outer casing. In other words, the center of mass of the motor will be shifted within the distorted outer casing after a period of continuous use of the motor. Once the center of mass of the motor is shifted, the motor will generate an uneven rotatable power to the fan blade so as to create the noise within the outer casing. Therefore, the air mover cannot be stably operated and the service life of the air mover will be substantially reduced. Furthermore, the motor is generally affixed between the top and bottom walls of the outer casing to enhance the stabilization of the motor. Therefore, the size of the outer casing must be large enough in order to hold the motor in position. Since there is no air filter provided at the air inlet, dust or other particles will be sucked into the outer casing. Therefore, dust will be accumulated at the motor to reduce the efficiency thereof and will be blown out at the air outlet as well to pollute the drying surface. In addition, the control panel is mounted at the outer casing to control the operation of the motor. Since the outer casing is a one single integrated body, the wiring configuration within the outer casing will be complicated to connect the motor with the control panel.

Alternatively, the motor can be mounted in the outer casing by screw structure. However, the motor cannot be securely mounted within the outer casing by such screw structure. Therefore, when the motor is operated, an unwanted vibration will be unavoidably generated. Since two sides of the outer casing forms the two air inlet, the motor must be mounted at the surrounding wall of the outer casing. A motor mount is incorporated with the motor in order to securely mount the motor in the outer casing at a position that the output shaft must be coaxially located at a longitudinal centerline of the outer casing. The motor stand generally comprises a mounting ring encirclingly mounted around the motor and a plurality mounting arms radially extended from the mounting ring to secure at the inner side of the surrounding wall of the outer casing via a plurality of screws. In other words, the motor is suspended and supported within the outer casing to retain the output shaft of the motor at the longitudinal centerline of the outer casing. However, once the motor is powered to generate a rotatable movement of the output shaft, the vibration of the motor will be concurrently generated, wherein the vibration will be transmitted to the outer casing through the mounting arms. Therefore, the screws will be loosened after a period of continuous use. In other words, the user must frequently check the mounting position of the motor and must re-tighten all the screws to secure the motor within the outer casing. Once the motor is unsecured in the outer casing, the output shaft will be misalign with the longitudinal centerline of the outer casing and the noise will be generated by the fan blade as well during operation.

The installation of the motor within the outer casing is relatively complicated. Since the motor must be installed within the outer casing, the technician is hard to reach the interior of the outer casing for securing the screws therewithin. Generally speaking, the outer casing comprises a first side casing and a second side casing asymmetrical to the first side casing, wherein the interior cavity of the first side casing is smaller than the interior cavity of the second side casing. In other words, a longitudinal length of the first side casing is shorter than a longitudinal length of the second side casing. Since the first side casing is smaller, the technician is able to easily reach the interior cavity of the first side casing to mount the motor therein. Therefore, the technician is able to secure the motor at the smaller casing first and then mount the larger casing to the smaller casing to enclose the motor within the outer casing. On the other hand, since the first side casing is smaller than the second side casing, the rigidity of the first side casing is weaker than that of the second side casing. Therefore, the first side casing cannot rigidly support the motor thereat especially when the motor is operating.

In addition, the control panel is mounted at the first side casing to operatively link to the motor. Therefore, the first side casing not only supports the motor but also retains the control panel in position, so as to further weaken the structure of the first side casing. In other words, all components of the air mover are leaned at the first side casing in an unbalanced manner.

SUMMARY OF THE PRESENT INVENTION

The invention is advantageous in that it provides an air mover which comprises a motor being easily assembled in a housing and being securely retained in the casing to minimize any unwanted vibration of the motor and to minimize the noise generated by the air flow.

Another advantage of the invention is to provide an air mover, wherein the motor is retained at the end panel of the housing and is securely locked up from the exterior of the end panel so that the air mover has a facility of assembly.

Another advantage of the invention is to provide an air mover, wherein an exterior brace is mounted at the outer side of the end panel to further lock up the motor and to enhance the rigidity of the end panel for supporting the motor thereat. In addition, the fasteners is covered by the exterior brace when the exterior brace is coupled at the end panel. Therefore, the fasteners cannot be accessed to release the engagement between the end panel and the motor when the exterior brace is coupled at the end panel.

Another advantage of the invention is to provide an air mover, wherein the housing comprises two symmetrical-sized casings to evenly distribute the load of the motor.

Another advantage of the invention is to provide an air mover, wherein two air filters are detachably coupled at two sides of the housing in a plug-and-lock manner so as to enhance the cleaning purpose of the air filters.

Another advantage of the invention is to provide an air mover, wherein the housing is stably supported on a ground via a floor stand at either a horizontal position or a tilted position for aiming the air stream of the air mover.

Another advantage of the invention is to provide an air mover, wherein the control panel is raised and mounted at the mid-portion of the housing for easy accessing.

Another advantage of the invention is to provide an air mover, wherein the cable is wound around the handle and the control panel to minimize the number of turns of the cable, so as to prevent the cable being accidentally intertwined.

Another advantage of the invention is to provide an air mover, wherein no expensive or complicated structure is required to employ in the present invention in order to achieve the above mentioned objects. Therefore, the present invention successfully provides an economic and efficient solution for providing a rigid configuration to stably support the motor and for simplifying the assembling process of the air mover.

Additional advantages and features of the invention will become apparent from to the description which follows, and may be realized by means of the instrumentalities and combinations particular point out in the appended claims.

According to the present invention, the foregoing and other objects and advantages are attained by an air mover which comprises a housing and an air stream generator.

The housing, having an air exit, comprises a first housing body and a second housing body symmetrical to the first housing body in size that inner sides of the first and second housing bodies are coupled with each other to define a centerline of the housing and a housing cavity within the housing, wherein the first housing body has an perforated end panel formed at an outer side thereof, wherein the second housing body has a side opening defined at an outer side thereof.

The air stream generator is coaxially supported within the housing cavity, wherein the air stream comprises a motor coupled at an interior side of the end panel of the first housing body via a locking mechanism and an impeller being powered by the motor to rotate for creating a suction effect within the housing cavity to suck air from two outer sides of the housing and to generate an air stream exiting at the air exit.

The locking mechanism is securely locked up the motor at the end panel of the first housing body from an exterior side of the end panel such that the motor is securely supported at the end panel of the first housing within the housing cavity.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
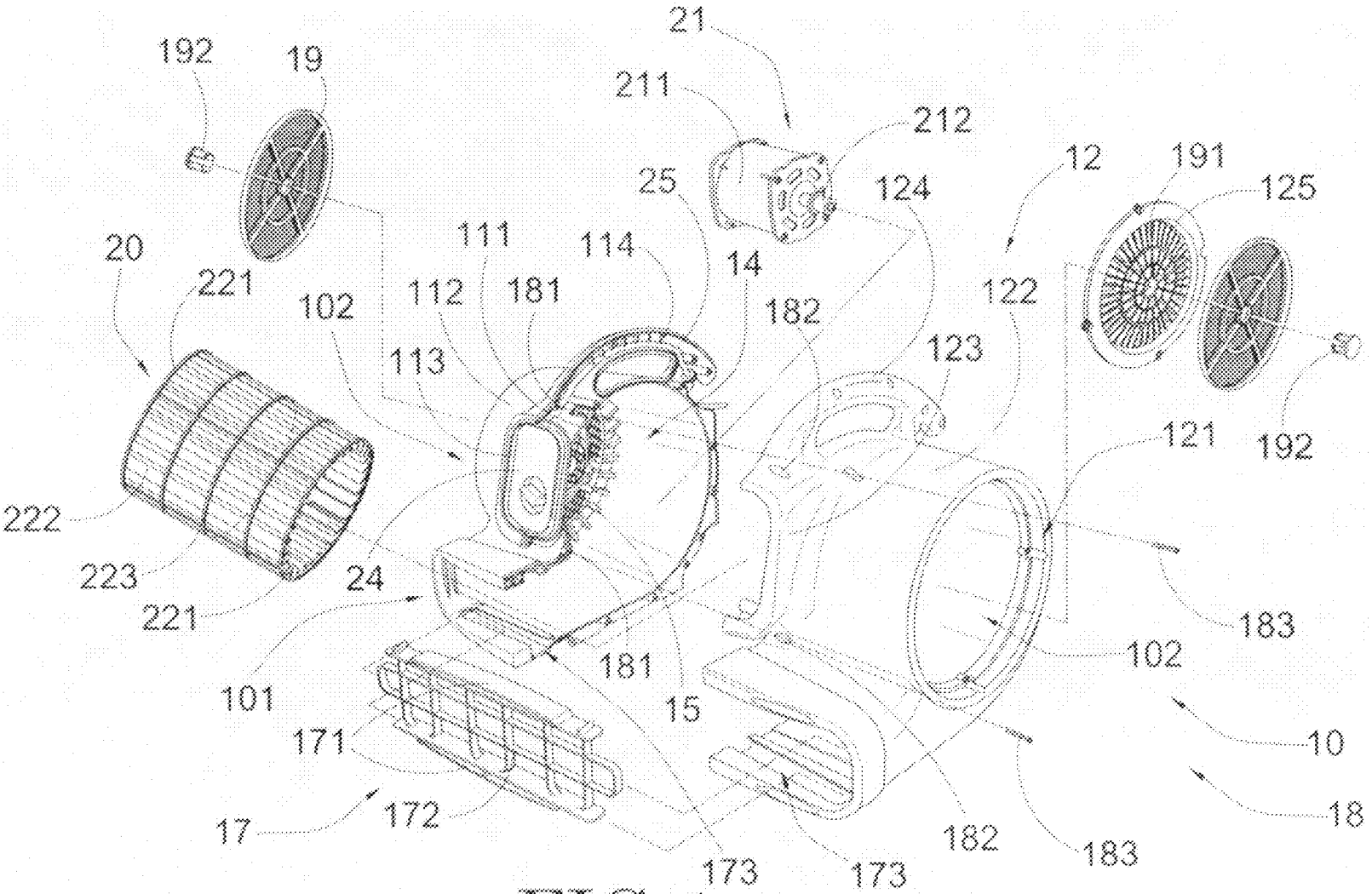
FIG. 1 is an exploded perspective view of an air mover according to a preferred embodiment of the present invention.

Referring to FIGS. 1 to 4 of the drawings, an air mover according to a preferred embodiment of the present invention is illustrated, wherein the air mover, which is adapted for drying surface and moving musty air, comprises a housing 10 and an air stream generator 20 received in the housing 10.

According to the preferred embodiment, the housing 10 has an air exit 101 provided a bottom portion thereof and two air inlets 102 provided at two outer sides of the housing 10. The air exit 101 is aligned horizontally when the housing 10 is rested on a ground.

As shown in FIGS. 1 to 4, the housing 10 comprises a first housing body 11 and a second housing body 12 symmetrical to the first housing body 11 in size, wherein each of the first and second housing bodies 11, 12 has an inner side and an outer side. The outer sides of the first and second housing bodies 11, 12 are the two outer sides of the housing 10 respectively. The inner sides of the first and second housing bodies 11, 12 are coupled with each other to define a centerline 13 of the housing 10 and a housing cavity 14 within the housing 10. Accordingly, the centerline 13 of the housing 10 formed along the connection line between the inner sides of the first and second housing bodies 11, 12. It is worth mentioning that the first and second housing bodies 11, 12 are symmetrical in size that a longitudinal length between the inner and outer sides of the first housing body 11 is the same as a longitudinal length between the inner and outer sides of the second housing body 12. In other words, the first and second housing bodies 11, 12 are two half housing bodies, i.e. left and right portions, of the housing 10.

The first housing body 11 has an perforated end panel 111 formed at the outer side thereof for enabling air entering into the housing cavity 14, and a cylindrical first surrounding wall 112 defining a portion of the housing cavity 14 therewithin. Preferably, the end panel 111 is integrally extended from the surrounding wall 112 to form a rigid body to support the air stream generator 20.

As shown in FIG. 1, the first and second bodies 11, 12 are coupled with each other by the attachment means 18. The attachment means 18 has a plurality of closed end first attachment grooves 181 spacedly and longitudinally extended from the inner side of the first housing body 11 toward the outer side thereof, a plurality of through second attachment grooves 182 spacedly and longitudinally extended to the inner side of the second housing body 12 to align with the first attachment grooves 181 when the inner sides of the first and second housing bodies 11, 12 are coupled with each other, and a plurality of elongated attachment fasteners 183 longitudinally extended from the second attachment grooves 182 to the first attachment grooves 181 to lock up the first and second housing bodies 11, 12 together. Preferably, the attachment fasteners 183 are a plurality of screws to lock up the first and second housing bodies 11, 12 together. It is worth mentioning that since the first and second housing bodies 11, 12 have equal longitudinal lengths, the first and second attachment grooves 181, 182 can be longitudinally prolonged at the first and second housing bodies 11, 12. Therefore, the length of the attachment fastener 183 can be used not only to securely lock up the first and second housing bodies 11, 12 together but also to enhance the rigidity of the housing 10 at the centerline 13 thereof.

The second housing body 12 has a side opening 121 defined at an outer side thereof as one of the air inlet 102 for enabling the air entering into the housing cavity 14 and a cylindrical second surrounding wall 122 defining another portion of the housing cavity 14 therebetween. Accordingly, when the first and second housing bodies 11, 12 are coupled with each other, the first surrounding wall 112 is coupled with the second surrounding wall 122 edge-to-edge that the first surrounding wall 112 is coaxially aligned with the second surrounding wall 122. Therefore, the first and second surrounding walls 112, 122 form a cylindrical surrounding wall of the housing 10 to form the housing cavity 14 therewithin, wherein the air stream generator 20 is coaxially encircled within the surrounding wall of the housing 10.

The first housing body 11 further comprises a first raised platform 113 frontwardly protruded from the first surrounding wall 112 at the inner side of the first housing body 11. The second housing body 12 further comprises a second raised platform 123 frontwardly protruded from the second surrounding wall 122 at the inner side of the second housing body 12. When the first and second housing bodies 11, 12 are coupled with each other, the first and second raised platforms 113, 123 form a raised frame frontwardly protruded from the surrounding wall of the housing 10, wherein the first and second raised platforms 113, 123 are symmetrical with respect to the centerline 13 thereof.

The first housing body 11 further comprises a first handle body 114 upwardly protruded from the first surrounding wall 112 at the inner side of the first housing body 11. The second housing body 12 further comprises a second handle body 124 upwardly protruded from the second surrounding wall 122 at the inner side of the second housing body 11. When the first and second housing bodies 11, 12 are coupled with each other, the first and second handle bodies 114, 124 form a handle frame upwardly protruded from the surrounding wall of the housing 10, wherein the first and second handle bodies 114, 124 are symmetrical with respect to the centerline 13 thereof.

Figure 4:
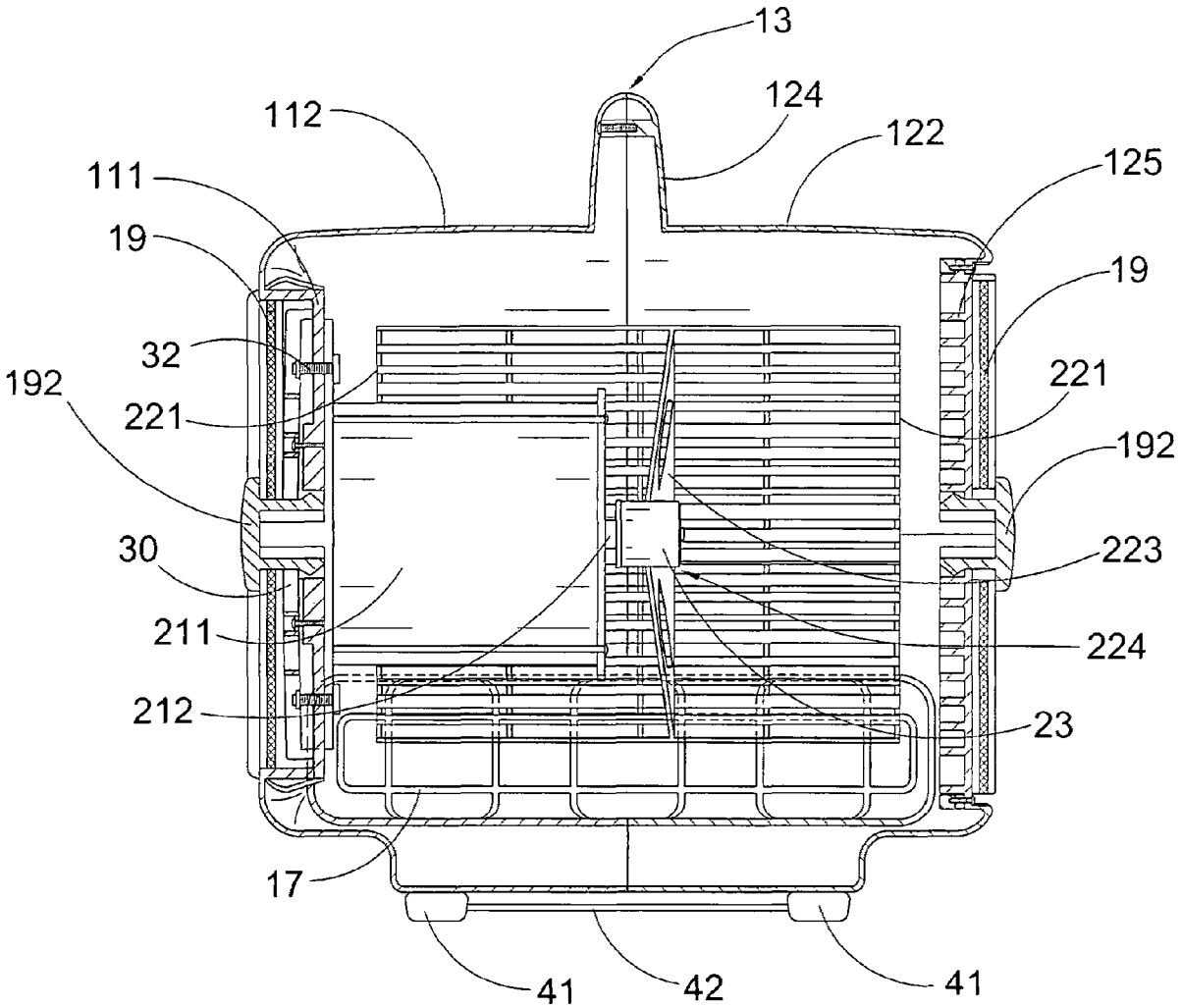
FIG. 4 is a front sectional view of the air mover according to the above preferred embodiment of the present invention.

As shown in FIGS. 1 and 4, the air stream generator 20 is coaxially supported within the housing cavity 14 of the housing, wherein the air stream generator 20 comprising a motor 21 coupled at an interior side of the end panel 111 of the first housing body 11 and an impeller 22 being powered by the motor 22 to rotate for creating a suction effect within the housing cavity 14 to suck the air from the two outer sides of the housing 10 and to generate an air stream exiting at the air exit 101 thereof.

The motor 21 is coupled at the interior side of the end panel 111 of the first housing body 11 via a locking mechanism 30, wherein the locking mechanism 30 is securely locked up the motor 21 at the end panel 111 of the first housing body 11 from an exterior side thereof such that the motor 21 is securely supported at the end panel 111 of the first housing 11 within the housing cavity 14.

Figure 2:
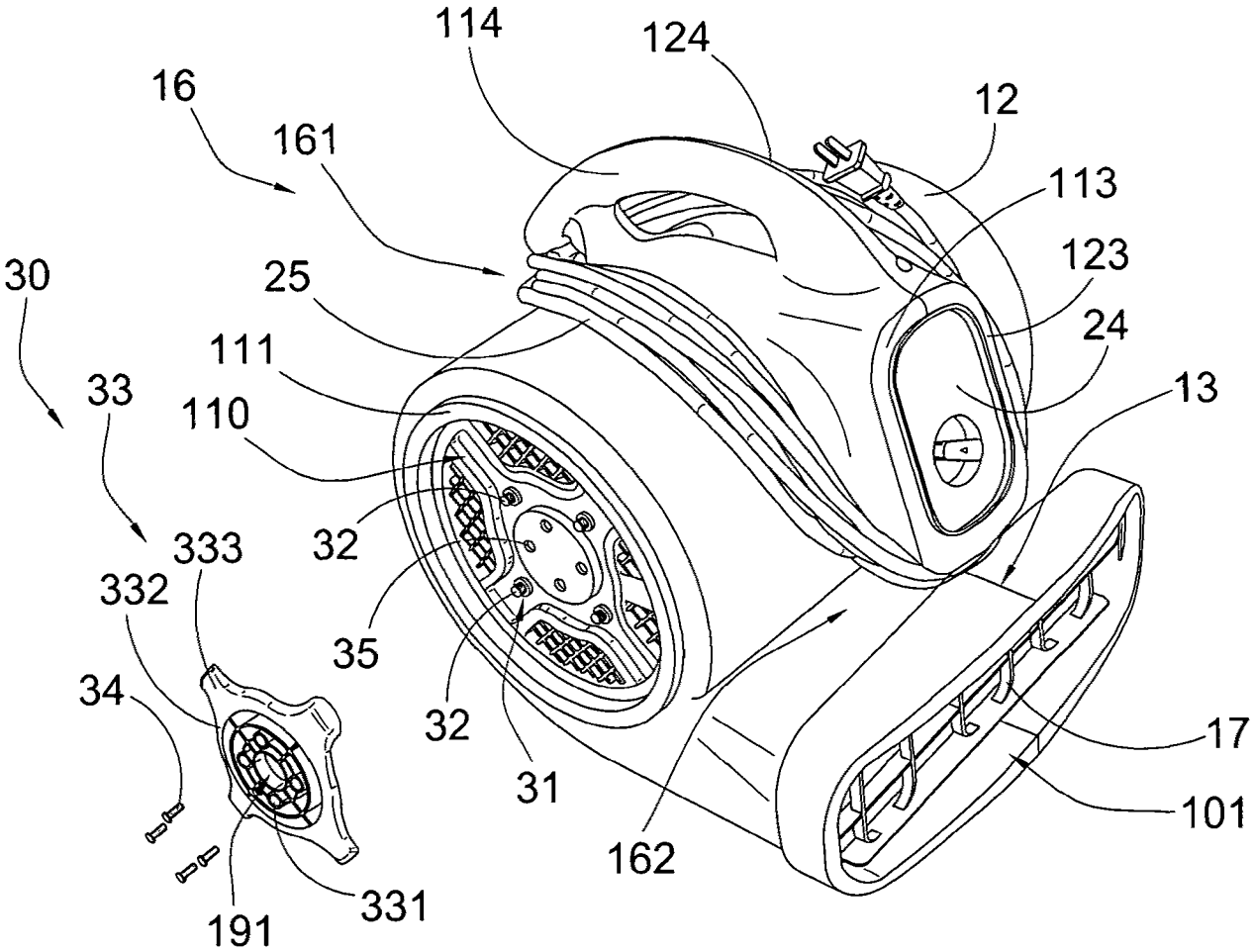
FIG. 2 is a perspective view of the air mover according to the above preferred embodiment of the present invention, illustrating the motor being secured to the end panel from an exterior side thereof and the exterior brace enhancing the rigidity of the end panel.

According to the preferred embodiment, the locking mechanism 30 has one or more through fastening holes 31 radially formed at the end panel 111, wherein the fastening holes 31 are spacedly formed to align with motor 21. The locking mechanism 31 further comprises one or more fasteners 32 extended from the exterior side of the end panel 111 through the fastening holes 31 to lock up the motor 21 at the interior side of the end panel 111 within the housing cavity 14. In other words, the user is able to easily mount the motor 21 at the interior side of the end panel 111 and to fasten the motor 21 at the exterior side of the end panel 111 via the fasteners 32. Preferably, the fasteners 32 are screws to extend from the exterior side of the end panel 111 to the interior side thereof through the fastening holes 31 in order to affix the motor 21. As shown in FIG. 2, each of the fastener 32 are a set of bolt and nut connection, wherein the bolt is extended from the interior of the housing 10 to the exterior thereof through the fastening holes 31 at the end panel 11 to support the motor 21 at the interior side of the end panel 111. The nut is fastened with the bolt at the exterior side of the end panel 11 to lock up the motor 21 within the housing 10. It is worth mentioning that the user is able to easily lock the nut with the bolt at the exterior side of the end panel 111 to simplify the installation process of the motor 21.

In order to further secure the motor 21 at the end panel 111 of the first housing body 11, the locking mechanism 30 further comprises an exterior brace 33 coupled at the exterior side of end panel 111. The exterior brace 33 has a plurality of through alignment holes 331 aligned with the cover fastening holes 35 for the cover fasteners 34 extended therethrough respectively, such that when the exterior brace 33 rested at the exterior side of the end panel 111, the end panel 111 is sandwiched between the exterior brace 33 and the motor 21. In addition, the exterior brace 33 and the end panel 111 form a double-wall structure for enhancing a rigidity of the end panel 111 to support the motor 21. Accordingly, the exterior brace 33 is made of heat insulation material such that when the exterior brace 33 is coupled at the end panel 111, the exterior brace 33 forms a heat insulation panel at the exterior side of the end panel 111. In addition, the fasteners 32 are covered by the exterior brace 33 in a hidden manner when the exterior brace 33 is coupled at the end panel 111. Therefore, the fasteners 32 cannot be accessed to release the engagement between the end panel 111 and the motor 21 when the exterior brace 33 is coupled at the end panel 111.

For preventing any unwanted movement of the exterior brace 33 with respect to the end panel 111, the end panel 111 has a plurality of retention recess 110 indented at the exterior side thereof. The exterior brace 33 has a retention body 332 rested at the exterior side of the end panel 111 and a plurality of retention arms 333 radially extended from the retention body 332 to receive at the retention recess 110. The alignment holes 331 are radially formed at the retention body 332 to align with the cover fastening holes 35. Accordingly, the retention arms 333 are radially and outwardly extended with respect to the center of the end panel 111 to further enhance the rigidity of the end panel 111 to support the motor 21. Preferably, the end panel 111 further has an indention communicated with the retention recess 110 that the retention body 332 is received at the indention to align the retention arms 333 with the retention recess 110. Therefore, when the retention body 332 is rested at the exterior side of the end panel 111, the exterior brace 33 cannot be moved thereat. It is worth mentioning that the exterior brace 33 can be formed in a non-circular shape to rest on the exterior side of the end panel 111 for preventing any unwanted movement of the exterior brace 33.

In order to further enhance the rigidity of the end panel 111, the housing 10 further comprises a plurality of reinforcement ribs 15 radially and integrally extended from the end panel 111 to the first surrounding wall 112 of the first housing body 11. Each of the reinforcement ribs 15 has a trapezoid shape provided at the outer peripheral portion of the end panel 111 at the interior side thereof, wherein one edge of the reinforcement rib 15 is integrally extended from the interior side of the end panel 11 while an adjacent edge of the reinforcement rib 15 is integrally extended from the interior side of the first surrounding wall 112 such that the reinforcement ribs 15 can enhance the rigidity of the end panel 111 to support the motor 21 thereat and can direct the air flow entering into the housing 10 through the air inlets 102. It is worth mentioning that the retention arms 333 are radially and outwardly extended from the center of the end panel 111 while the reinforcement ribs 15 are radially extended from the outer peripheral portion of the end panel 111. Therefore, the rigidity of the end panel 111 can be substantially enhanced to support the motor 21 especially when the motor 21 is operating.

As shown in FIGS. 1 and 4, the motor 21 comprises a motor body 211 being secured at the interior side of the end panel 111 and an output shaft 212 extended from the motor body 211 to couple with the impeller 22. In particular, the motor body 211 is coaxially encircled within the first surrounding wall 112 of the first housing body 11 while the output shaft 212 is coaxially encircled within the second surrounding wall 122 of the second housing body 12. Accordingly, the motor body 211 is coaxially extended from the end panel 111 to the centerline 13 of the housing 10 while the output shaft 212 is coaxially extended from the centerline 13 of the housing 10 toward the side opening 121 of the second side housing 12. Therefore, the installation of the motor can be simplified by simply disposing the motor body 211 within the first housing body 11 and fastening the motor body 211 at the interior side of the end panel 111 via the fasteners 32 from the exterior side of the end panel 111.

It is worth mentioning that since the output shaft 212 is coaxially extended from the centerline 13 of the housing 10, the impeller 22 is well-balanced and supported within the housing cavity 14 such that when the impeller 22 is driven by motor unit 211, the impeller 22 will be rotated within the housing cavity 14 in a balancing manner.

As shown in FIGS. 1 and 4, the impeller 22 comprises two circular side frames 221 and a plurality of blades 222 spacedly extended between the side frames 221 such that when the impeller 22 is driven to rotate, the blades 222 are moved around the housing cavity 14 to generate the suction effect therewithin. Accordingly, each of the blades 222 has a predetermined curvature that when the blades 22 are driven to move within the housing cavity 14, the air will be drawn from the two outer sides of the housing 10 to form the air stream.

Figure 3:
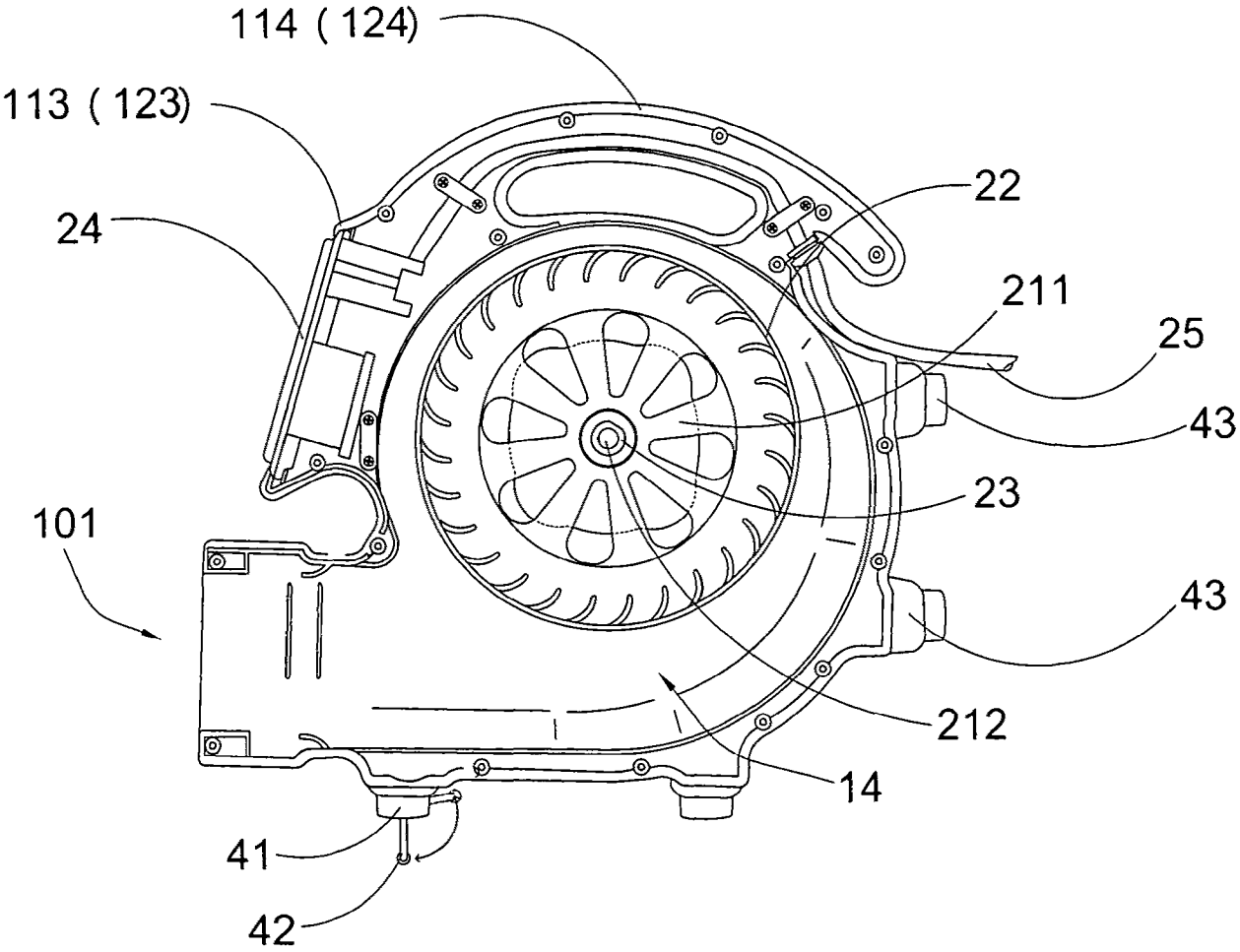
FIG. 3 is a side sectional view of the air mover according to the above preferred embodiment of the present invention.

The impeller 22 further comprises a mounting frame 223 positioned between the side frames 221, preferably at the middle of the impeller 22, to couple with the output shaft 212 of the motor 21. The mounting frame 223 has a through coupling slot 224 provided at a center thereof, wherein the output shaft 212 is extended through the coupling slot 224 to securely couple the impeller 22 to the motor 21. As shown in FIGS. 3 and 4, the output shaft 212 has a circular cross section while the coupling slot 224 has a non-circular cross section. The impeller 22 further comprises a shaft coupler 23 for coupling the output shaft 212 at the coupling slot 224. The shaft coupler 23 is made of rigid, lightweight, and heat isolated material, wherein the shaft coupler 23 is formed as an adapter to secure the output shaft 212 at the coupling slot 224 and as a heat isolator for preventing the heat being transmitted from the motor 21 to the impeller 22. Accordingly, the shaft coupler 23 has an inner circular slot fittingly coupled with the output shaft 212 and an outer non-circular surface fittingly coupled with the coupling slot 224 of the mounting frame 223, such that when the rotational power is generated at the output shaft 212, the shaft coupler 23 is adapted to transmit the rotational power to the impeller 22 to drive the impeller 22 to rotate within the housing cavity 14.

Accordingly, the mounting frame 223 is positioned at the middle of the side frames 221 such that the blades 222 are extended from one of the side frames 221 to another side frame 221 and are supported by the mounting frame 223. In particular, each blade 222 has two symmetrical portions being supported by the side frames 221 and the mounting frame 223. Therefore, the impeller 22 defines two symmetrical side portions along the mounting frame 223 that the motor unit 211 is coaxially received in one of the side portions of the impeller 22 between the respective side frame 221 and the mounting frame 223 while the output shaft 212 is coaxially received in another side portion of the impeller 22 between the respective side frame 221 and the mounting frame 223. Therefore, the mounting frame 223 not only supports the blades 222 in position but also ensures the impeller 22 being rotated within the housing cavity 14 in a balancing manner.

According to the preferred embodiment, the air stream generator 20 further comprises a control panel 24 supported at the raised frame of the housing 10 and operatively linked to the motor 20 to control the operation of the motor 20. The control panel 24 is arranged to selectively switch on-and-off the power of the motor 20 and to selectively control the rotational speed of the impeller 22 via the motor unit 211. It is worth mentioning that the control panel 24 is positioned at the middle of the housing 10 at the front side thereof such that the user is able to easily control the operation of the motor 20.

In addition, the air stream generator 20 further comprises a connection cable 25 operatively linked to the control panel 24 and extended within the handle frame of the housing 10 to a rear side thereof. In particular, the connection cable 25 is extended along an interior space formed within the first and second handle bodies 114, 124 of the first and second housing bodies 11, 12 when they are coupled with each other. Therefore, the hidden extension portion of the connection cable 25 is hidden within the handle frame of the housing 10 from the front side of the housing 10 to the rear side thereof, wherein the hidden extension portion of the connection cable 25 is a portion thereof extended from the control panel 24 so as to ensure the connection between the connection cable 25 and the control panel 24.

The exposed extension portion of the connection cable 25 is extended from the rear side of the housing 10 and is long enough to electrically connect to an external power outlet. Since the exposed extension portion of the connection cable 25 is relatively long, it is always a hassle for the user to store the exposed extension portion of the connection cable 25 when the air mover of the present invention is not in use.

The housing 10 further comprises a holding means 16 for holding the connection cable 25 in position, wherein the holding means 16 comprises a first cable holder 161 formed at an upper end of the handle frame of the housing 10 and a second cable holder 162 formed at a bottom end of the raised frame of the housing 10. The connection cable 25 is retracted and wound between the first and second cable holders 161, 162 for minimizing a number of turns of the connection cable 25. Accordingly, the upper end of the handle frame of the housing 10 is configured to have a hook-shape so as to form the first cable holder 161. Likewise, the bottom end of the raised frame of the housing 10 is configured to have a hook-shape so as to form the second cable holder 162. It is worth mentioning that the upper end of the handle frame of the housing 10 is positioned at the rear side of the housing 10 close to the top side thereof. The bottom end of the raised frame of the housing 10 is positioned at the front side of the housing 10 close to the bottom side thereof. Therefore, the distance between the first and second holders 161, 162 is substantially prolonged to hold the connection cable 25 in a winding manner. In addition the handle frame and the raised frame of the housing 10 form a dividing guide for enabling the connection cable 25 being wound therearound.

The housing 10 further comprises an air guider 17 mounted at the air exit 101 in a screw-less manner, as shown in FIG. 1. The air guider 17 comprises a surrounding frame 171 encircled within a surrounding wall of the air exit 101 and a plurality of air guiding panels 172 spacedly and longitudinally extended within the surrounding frame 171 for directing the air stream out of the air exit 101. Accordingly, in order to mount the air guider 17 at the air exit 101 in a screw-less manner, the air guider 17 further has an indented groove 173 formed at each of the first and second housing bodies 11, 12, wherein when the first and second housing bodies 11, 12 are coupled with each other the indented grooves 173 form an indented loop that the indented loop is indented around an inner wall of the air outlet 101 of the housing 10. The surrounding frame 171 is embedded within the indented loop to retain the air guider 17 at the air exit 101. In other words, no screw is required to affix the air guider 17.

The housing 10 further comprises a perforated end cover 125 detachably coupled at the outer side of the second side housing 12 to cover the side opening thereof, wherein the end cover 125 is formed at one of the air inlets 102 of the housing 10 for enabling the air entering into the housing cavity 14 through the end cover 125. Accordingly, the end cover 125 has a circular shape corresponding to the end panel 111 of the first housing body 11.

Figure 6:
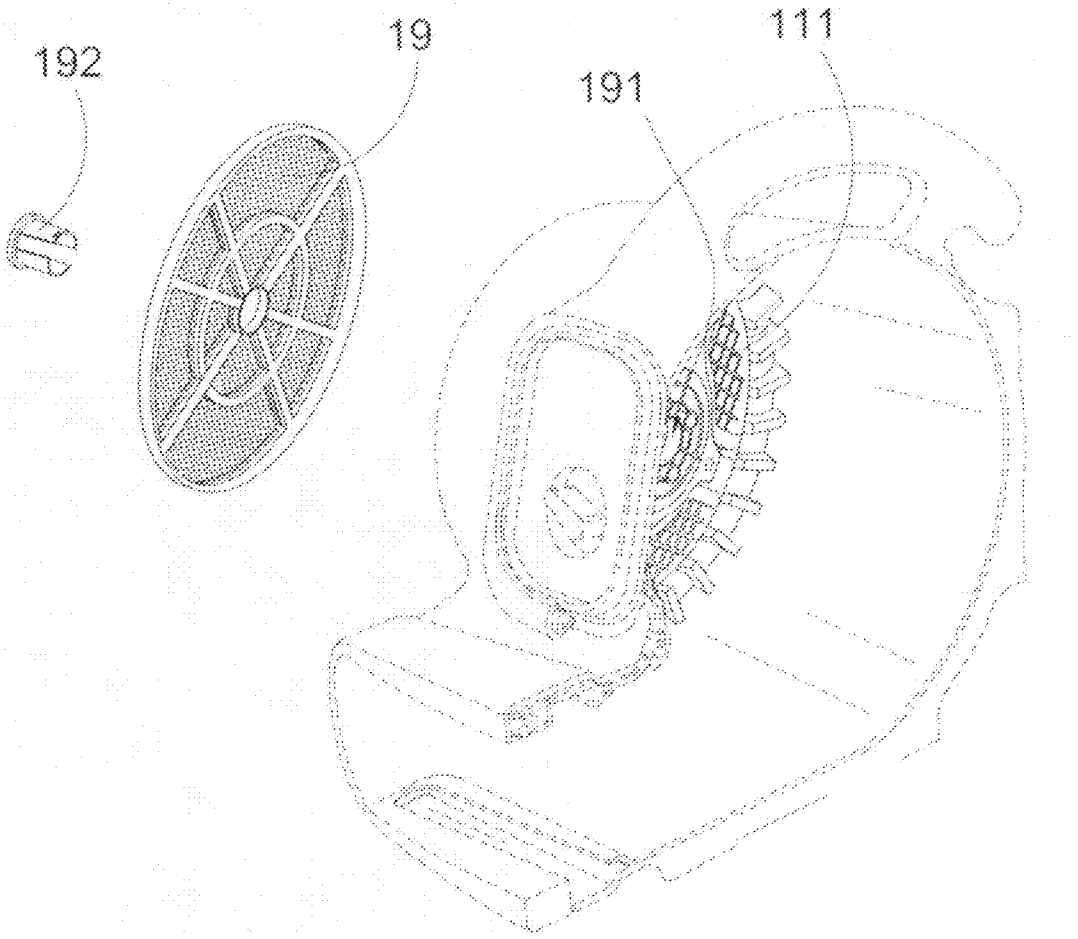
FIG. 6 is a perspective view of the air filter being coupled at the side opening of the housing in a plug-and-lock manner according to the above preferred embodiment of the present invention.
Figure 7:
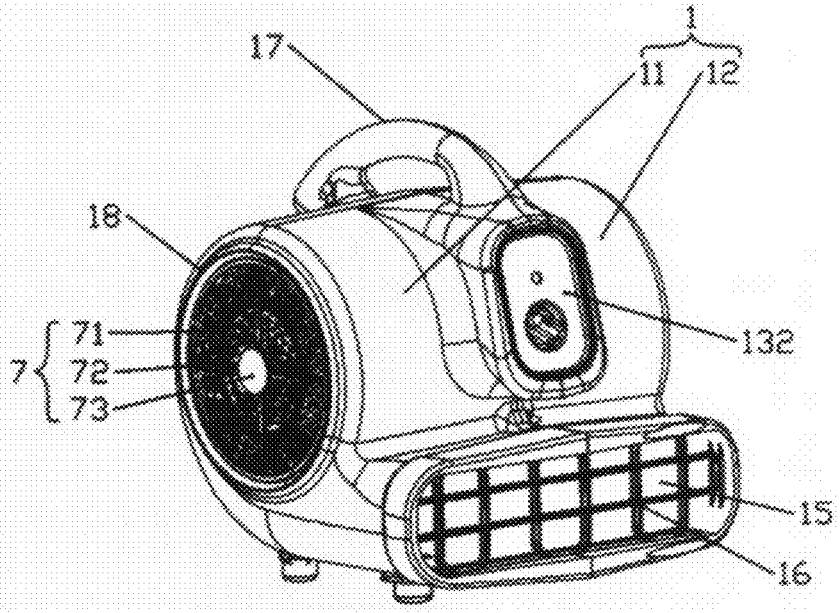
FIG. 7 is a perspective view of an air mover according to a second embodiment of the present invention.
Figure 8:
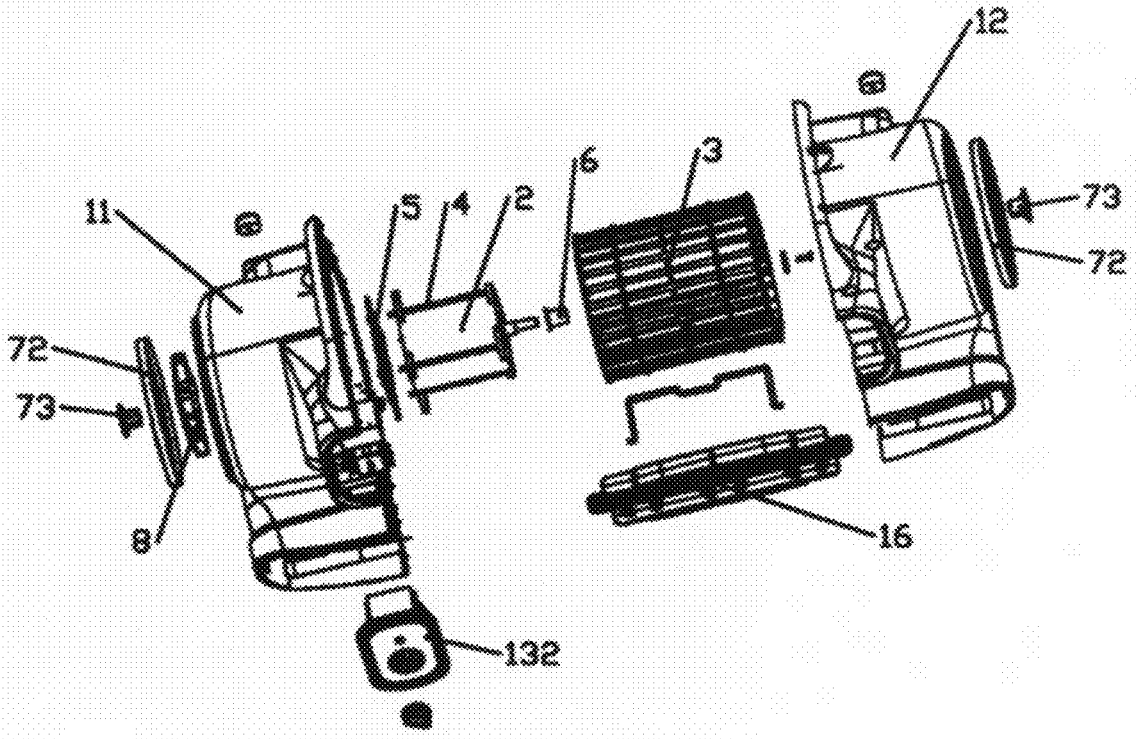
FIG. 8 is an exploded perspective view of the air mover according to the above second embodiment of the present invention.

As shown in FIGS. 1 and 6, the housing 10 further comprises two air filters 19 detachably coupled with the end panel 111 and the end cover 125 respectively via a tool-less engaging unit. Accordingly, each of the air filters 19 has a mesh surface for filtering the air being entered into the housing cavity 14 from the air inlet 102 so as to prevent dust and unwanted particles entering into the housing cavity 14.

The tool-less engaging unit has a locking channel 191 coaxially formed at a center of each of the end panel 111 and the end cover 125, and comprises a plug-and-lock member 192 coaxially protruded from a center of each of the air filters 19, such that when the plug-and-lock members 192 are detachably inserted into the locking channels 191 respectively, the air filters 19 are securely coupled at the outer sides of the housing 10 respectively, so as to retain the air filters 19 at the air inlets 102 of the housing 10.

The plug-and-lock member 192 comprises two parallel members spacedly extended with each other and has a latching free end arranged when the plug-and-lock member 192 is inserted into the locking channel 191, the two parallel members are slightly pressed and the latching free end is engaged with the inner wall of the locking channel 191.

Figure 5:
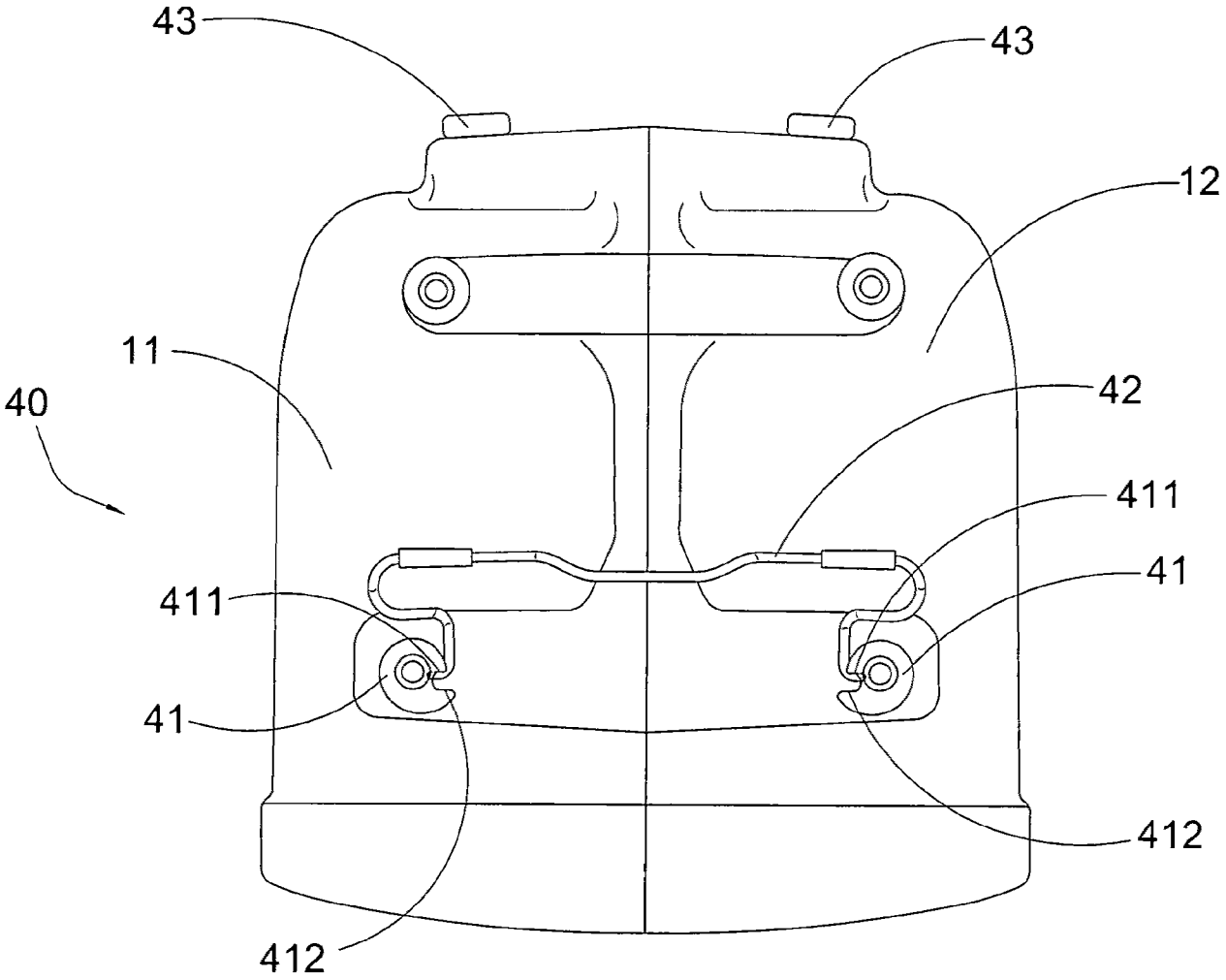
FIG. 5 is a bottom view of the air mover according to the above preferred embodiment of the present invention, illustrating the adjustable stand of the air mover.

As shown in FIGS. 3 and 5, the air mover of the present invention further comprises an adjustable stand 40 for adjustably retaining the housing 10 at different angles with respect to the ground surface. Accordingly, the adjustable stand 40 comprises two elastic members 41 spaced from at a bottom side of the housing 10 for resting on the ground surface at a position that the air exit 101 is horizontally aligned with the ground surface. Therefore, the air stream exiting at the air exit 101 will flow horizontal to the ground surface. The adjustable stand 40 further comprises a folding stand 42 pivotally coupled between the elastic members 41 to selectively adjust an orientation of the air exit 101 with respect to the ground surface. Accordingly, the folding stand 42 having a U-shaped configuration defines two side arms pivotally coupled with the elastic members 41 respectively, wherein the folding stand 42 is adapted to pivotally fold between a horizontal position and a tilted position. At the horizontal position, the folding stand 42 is rearwardly folded to the bottom side of the housing 10 to enable bottom side of the housing being horizontal rested on the ground surface via the elastic members 41, such that the air stream exiting at the air exit 101 will flow horizontal to the ground surface. At the tilted position, the folding stand 42 is frontwardly folded away from the bottom side of the housing 10 to enable the housing being slantedly rested on the ground surface via the folding stand 41. Therefore, the air exit 101 is supported at a tilted orientation that the air stream exiting at the air exit 101 will flow upwardly and frontwardly with respect to the ground surface.

In particular, the elastic members 41 can retain the folding stand 42 between the horizontal position and the tilted position by the elastic ability. Each of the elastic members 41 has a holding surface 411 for slidably retaining the folding stand in position and a stopper edge 412 for holding the folding stand 42 at the tilted position. Accordingly, the side arms of the folding stand 42 are biased against and slid at the holding surface 411 of the elastic members 41 such that when the folding stand 42 is pivotally folded between the horizontal position and the tilted position, the holding surface 411 of the elastic members 41 can hold the folding stand 42 in position. It is worth mentioning that the elastic members 41 are preferably made by rubber such that the elastic members 41 can absorb the vibration of the housing 10 when the motor 20 is operating and can provide the elastic force to hold the folding stand 42 in position.

The adjustable stand 40 further comprises a plurality of upright standing members 43, which are made of elastic material such as rubber, spacedly provided at the rear side of the housing 10, wherein the rear side of the housing 10 is adapted to rest on the ground surface via the upright standing members 43. Therefore, the air exit 101 can be selectively adjusted to upwardly and vertically align with the ground surface to guide the air stream flowing upwardly.

As shown in FIGS. 8 to 14, an air mover according to a second embodiment illustrates an alternative mode of the first embodiment, wherein the above preferred embodiment can be alternatively interpreted in the following description. The air mover comprises a housing 1, a control unit, a cable 9, a motor 2, and an impeller 3.

Figure 9:
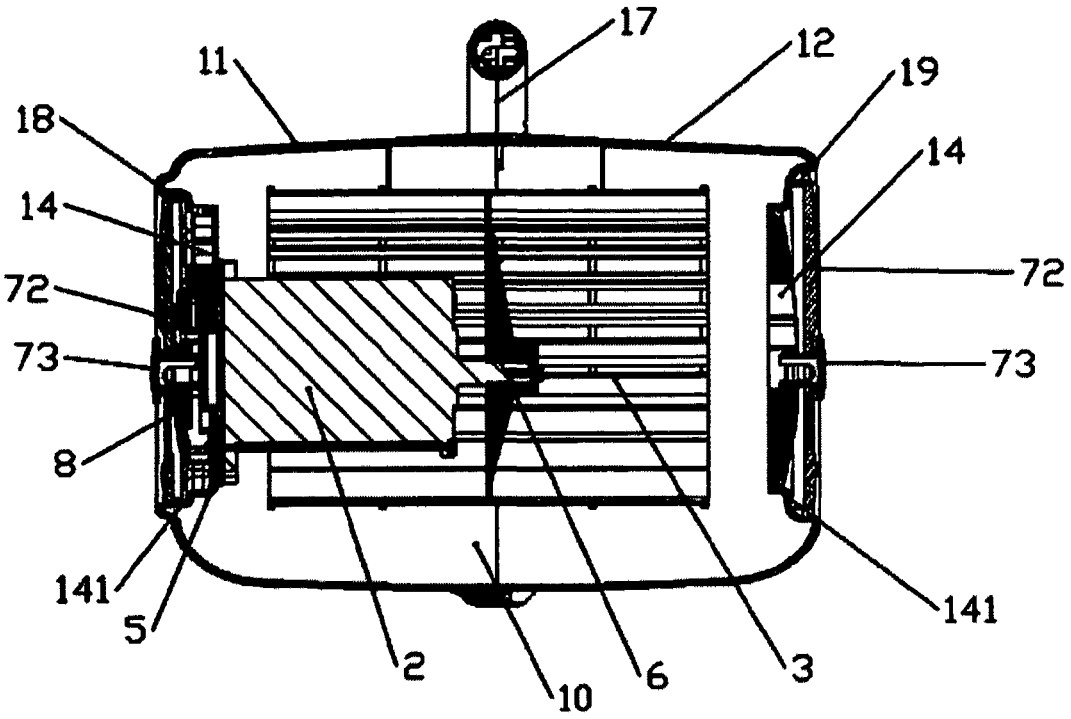
FIG. 9 is a front sectional view of the air mover according to the above second embodiment of the present invention.

As shown in FIG. 9, the housing 1 comprises a first housing body 11 and a second housing body 12 symmetrical to the first housing body 11 in size, wherein the first and second housing bodies 11, 12 are embodied as a left housing body and a right housing body respectively. The first and second housing bodies 11, 12 are coupled at the inner sides thereof via a screw structure. Two outer sides of the first and second housing bodies 11, 12 form two air inlets 14, 15 of the housing 1 respectively. An air outlet 15 is formed at the front sides of the first and second housing bodies 11, 12 when the first and second housing bodies 11, 12 are coupled with each other. An indented groove 151 is formed around the inner wall of the air outlet 15 when the first and second housing bodies 11, 12 are coupled with each other. An air guider 16 is mounted at the air outlet 15 and is retained at the indented groove 151. In addition, a supporting frame is provided at the bottom side of the housing 1 at the air outlet 15 thereof.

Figure 10:
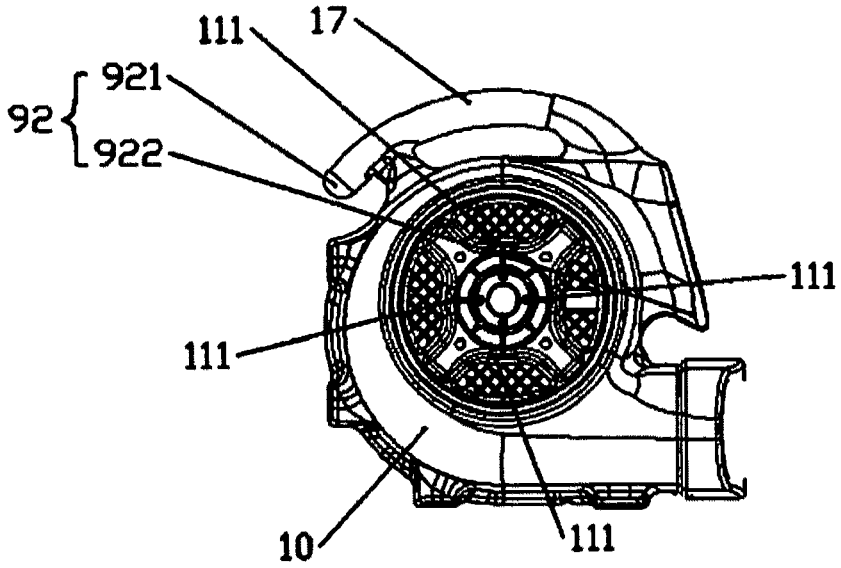
FIG. 10 is a side view of the air mover according to the above second embodiment of the present invention.
Figure 11:
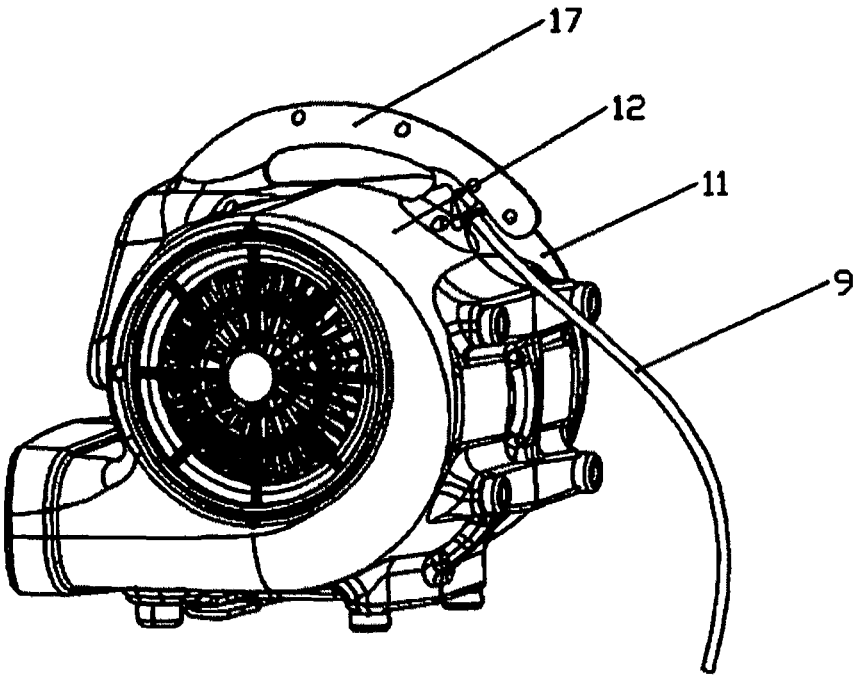
FIG. 11 is a perspective view of the air mover according to the above second embodiment of the present invention, illustrating the cable being extended out at the rear side of the housing.
Figure 12:
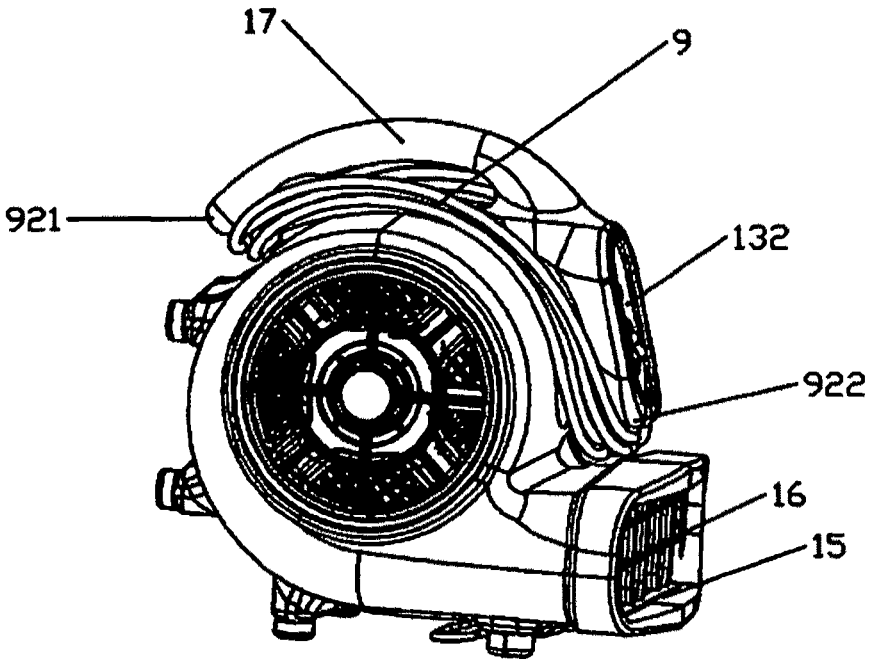
FIG. 12 is a perspective view of the air mover according to the above second embodiment of the present invention, illustrating the cable being wound by the cable holder.
Figure 13:
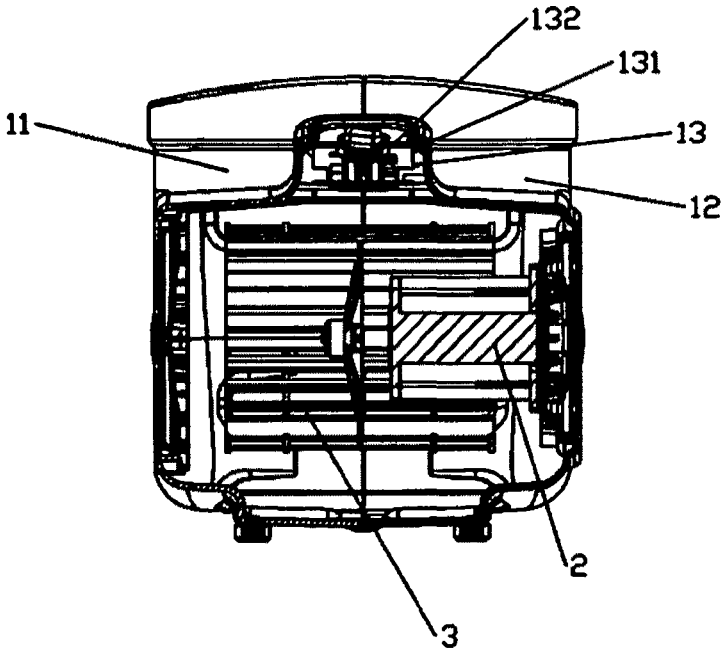
FIG. 13 is a top sectional view of the air mover according to the above second embodiment of the present invention.
Figure 14:
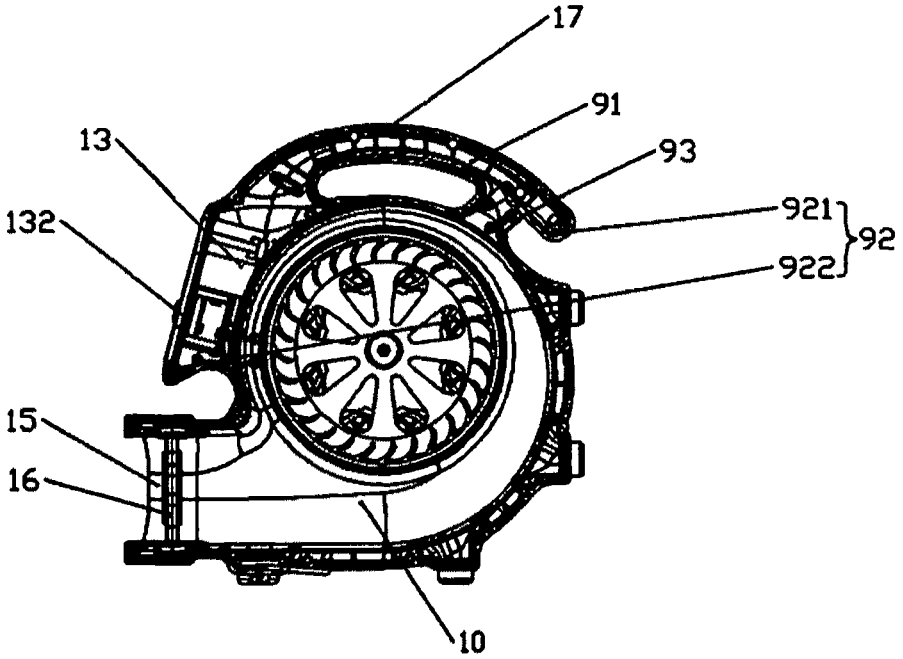
FIG. 14 is a side sectional view of the air mover according to the above second embodiment of the present invention.

The housing 1 further comprises an arc-shaped handle frame 17 upwardly protruded from the surrounding wall of the housing 1 for enabling the user to easily carry the air mover. Accordingly, the first housing body 11 further comprises a first handle body upwardly protruded from the first surrounding wall at the inner side of the first housing body 11. The second housing body 12 further comprises a second handle body upwardly protruded from the second surrounding wall at the inner side of the second housing body 11. When the first and second housing bodies 11, 12 are coupled with each other, the first and second handle bodies form the handle frame 17 upwardly protruded from the surrounding wall of the housing 1, wherein the first and second handle bodies are symmetrical with respect to the centerline thereof. As shown in FIG. 14, the handle frame 17 has a hollow configuration to form a cable extending chamber 91, wherein the cable 9 is extended through the cable extending chamber 91 and is extended out of the rear side of the housing 1 at the centerline thereof. A cable protection sleeve 93 is formed at the cable outlet of the housing 1 to protect the cable 9 being extended out of the rear side of the housing 1 and to retain a distance of the cable 9 between the control panel and the cable outlet along the cable extending chamber 91. As shown in FIG. 11, a raised frame 13 is formed and is frontwardly protruded from the surrounding wall of the housing 1. The first housing body 11 further comprises a first raised platform frontwardly protruded from the first surrounding wall at the inner side of the first housing body 11. The second housing body 12 further comprises a second raised platform frontwardly protruded from the second surrounding wall at the inner side of the second housing body 12. When the first and second housing bodies 11, 12 are coupled with each other, the first and second raised platforms form the raised frame 13 frontwardly protruded from the surrounding wall of the housing 1, wherein the first and second raised platforms are symmetrical with respect to the centerline thereof. An indented channel 131 is formed around the inner wall of the raised frame 13 when the first and second housing bodies 11, 12 are coupled with each other. A control panel 132 supported at the raised frame 13 of the housing 1 and is retained at the indented channel 131. As shown in FIG. 13, the air mover further comprises a holding means 92 for holding the cable 9 in position, wherein the holding means 92 comprises a first cable holder 921 formed at an upper end of the handle frame 17 of the housing 1 and a second cable holder 922 formed at a bottom end of the raised frame 13 of the housing 10. The cable 9 is retracted and wound between the first and second cable holders 921, 922 for minimizing a number of turns of the cable 9. Accordingly, the first and second cable holders 921, 922 are embodied as two hooking elements to hold the cable 9 in position, as shown in FIGS. 10, 12, and 14.

According to the second embodiment, the motor 2 and the impeller 3 are mounted in the housing 1 individually. The motor 2 is coaxially coupled at one of the outer sidewalls of the housing 1 via a securing unit 4. In particular, the motor 2 is securely coupled at the left outer sidewall of the housing 1 via the securing unit 4. Accordingly, the housing 1 further comprises a reinforcing rib 111 provided at the corresponding outer sidewall of the housing 1, as shown in FIG. 10, to form a double wall structure to support the motor 2 thereat, wherein the reinforcing rib 111 can stabilize the operation of the motor 2 and the distortion of the housing 1 due to the heat from the motor 2. A heat isolating layer 5 is provided between the outer sidewall of the housing 1 and the motor 2 to prevent the heat from the motor 2 being transmitted to the housing 1. The securing unit 4 comprises a plurality of elongated screws, preferably four screws, to secure the motor 2 at the corresponding outer sidewall of the housing 1. The elongated screws are evenly and radially coupled at the outer sidewall to retain the motor 2 in position so as to evenly distribute the supporting force at the outer sidewall. Therefore, the motor 2 can be rigidly supported at the outer sidewall to prevent the distortion of the outer sidewall due to the weight of the motor 2. In other words, the motor 2 can be stably operated to prolong the service life span of the motor 2. The housing 1 further comprises an exterior brace 8 coupled at the exterior side of outer sidewall of the housing to further enhance the strength of the outer sidewall. Accordingly, the impeller 3 is coupled at the output shaft of the motor 2. A shaft coupler 6 is provided for coupling the output shaft of the motor to the impeller 3, wherein the shaft coupler 6 is made of rigid, lightweight, and heat isolated material, such that the shaft coupler 6 is formed as an adapter to secure the output shaft and as a heat isolator for preventing the heat being transmitted from the motor 2 to the impeller 3. It is worth mentioning that since the motor 2 is directly coupled at one of the sidewalls of the housing 1, no metal supporting frame is required in the air mover to support the motor 2. Therefore, the overall weight of the air mover will be substantially reduced.

An air filter 7 is provided at each of the air inlets 14, wherein the air filter 7 comprises a filtering mesh 71, a filter supporting frame 72, and a locker 73. The filtering mesh 71 is fixed to the filter supporting frame 72 which is detachably coupled at the respective air inlet 14 through the locker 73. In particular, the filter supporting frame 72 has a corresponding shape and size matching with the sidewall of the housing 1 and has a frame structure to retain the filtering mesh 71 in position. The filter supporting frame 72 has a center through hole, wherein the locker 73 is extended through the center through hole of the filter supporting frame 72. A corresponding locking slot is formed at the exterior brace 8 to detachably couple with the locker 73 so as to retain the filter supporting frame 72 at the outer sidewall of the housing 1. Preferably, the locker 73 has a plug-in structure that a protrusion edge is formed at the free end of the locker 73 while an indented groove is formed at the inner wall of the locking slot. Therefore, the air filter 7 can be easily coupled at the outer sidewall of the housing 1 to prevent any dust or particle entering into the housing 1 and can be easily detached from the outer sidewall of the housing 1 for cleaning purpose. In other words, the air filter 7 can keep the interior of the housing 1 clean to prolong the service life span of the motor 2 and to enable the air mover being operated under dusty condition.

The air inlet 14 is formed in circular shape to enlarge the air intake area and to minimize an unfavorable air movement entering into the housing 1, so as to ensure the air being regularly and gently sucked into the housing 1. The housing further comprises a plurality of windshield ribs 141 radially and integrally extended from the outer sidewall of the housing 1 at the interior thereof. The windshield ribs 141 can enhance the rigidity of the outer sidewall to support the motor 2 thereat and can direct the air flow entering into the housing 1 through the air inlets 14. In other words, the windshield ribs 141 will direct the air flow from the air inlets 14 to the air outlet 15 to minimize the noise generated by the air flow within the housing 1.

In addition, an air channel 10 is formed between the housing 1 and the impeller 3, wherein the air channel 10 is a spiral shaped air channel that the opening width thereof is gradually increasing. In particular, the inner wall of the housing 1 is a smooth surface to minimize the air resistance. The opening width of the air channel 10 is gradually increasing from the top portion of the housing 1 to the front portion thereof through the rear portion so as to concentrate the air flow at the center of the housing 1 for enhancing the efficiency of the air mover.

The housing 1 further comprises a circular first surrounding rib 18 outwardly protruded from one outer sidewall of the housing 1 and a circular second surrounding rib 19 indented at another outer sidewall of the housing 1. Since the first and second housing bodies 11, 12 are symmetrical, the housing 1 provides a relatively strong supporting structure. Comparing with a one piece integrated housing, the thickness of the one piece integrated housing must be increased, especially at the mid portion thereof, to support the motor so as to prevent the distortion of the housing. Therefore, the thickness of the housing 1 of the present invention can be further reduced to decrease the overall weight of the air mover without weakening the structure of the housing 1. In addition, the width of the housing 1 is the overall widths of the first and second housing bodies 11, 12, the mid portion support at the housing 1 can be enhance by the screw structure. In other words, the screw structure not only securely couples the first and second housing bodies 11, 12 with each other but also enhances the mid strength-support of the housing 1. In addition, the mold of the housing 1 can be easily formed to manufacture the first and second housing bodies 11, 12 individually, so as to reduce the manufacturing cost of the housing 1. In other words, each of the first and second housing bodies 11, 12 can be easily modified to have the smooth inner surface, to precisely configure the air channel, and to reduce the air resistance. Furthermore, the handle frame 17 can be formed by the first and second housing bodies 11, 12 to retain the cable 9 in position while the control panel can be easily retained by the connection of the first and second housing bodies 11, 12. Therefore, the entire air mover of the present invention forms a neat and unique structure to incorporate with all components. It is worth mentioning that since the cable 9 is held within the handle frame 17, the operation of the motor 2 or the impeller 3 will not be blocked by the cable 9 while the cable 9 will not block the air flow within the housing 1 as well so as to minimize the air resistance and noise.

It is worth mentioning that the motor 2 can be mounted at either the left or right outer sidewall of the housing 1 by adding the reinforcing rib 111 and the exterior brace 8 to the corresponding outer sidewall of the housing 1.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An air mover, comprising:

a housing, having an air exit, which comprises a first housing body and a second housing body symmetrical to said first housing body in size such that inner sides of said first and second housing bodies are coupled with each other to define a centerline of said housing and a housing cavity within said housing, wherein said first housing body has a perforated end panel formed at an outer side thereof, wherein said second housing body has a side opening defined at an outer side thereof;

an air stream generator, which is coaxially supported within said housing cavity, comprising a motor coupled at an interior side of said end panel of said first housing body and an impeller being powered by said motor to rotate for creating a suction effect within said housing cavity to suck air from the two outer sides of said housing and to generate an air stream exiting at said air exit; and a locking mechanism securely locked up said motor at said end panel of said first housing body from an exterior side of said end panel such that said motor is securely supported at said end panel of said first housing within said housing cavity, wherein said locking mechanism has a plurality of through fastening holes radially formed at said end panel and comprises a plurality of fasteners extended from said exterior side of said end panel through said fastening holes to lock up said motor at said interior side of said end panel within said housing cavity, wherein said locking mechanism further comprises an exterior brace coupled at said exterior side of end panel for enhancing a rigidity of said end panel to support said motor, wherein said fasteners are covered by said exterior brace when said exterior brace is coupled at said end panel, such that said fasteners are inaccessible to release an engagement between said end panel and said motor when said exterior brace is coupled at said end panel, wherein said end panel has a plurality of retention recess indented at said exterior side thereof, wherein said exterior brace has a retention body rested at said exterior side of said end panel, a plurality of retention arms radially extended from said retention body to receive at said retention recess, and a plurality of through alignment holes aligned with said fastening holes for said fasteners extended therethrough respectively, such that when said retention body rested at said exterior side of said end panel, said end panel is sandwiched between said exterior brace and said motor.

2. The air mover, as recited in claim 1, wherein said motor comprises a motor body being secured at said interior side of said and panel and an output shaft extended from said motor body to couple with said impeller, wherein said motor body is coaxially extended from said end panel to said centerline of said housing while said output shaft is coaxially extended from said centerline of said housing toward said side opening of said second side housing.

3. The air mover, as recited in claim 2, wherein each of said first and second housing bodies comprises a cylindrical surrounding wall to coaxially encircle with said air stream generator and a raised platform frontwardly protruded from said surrounding wall at said inner side of each of said first and second housing bodies, such that when said first and second housing bodies are coupled with each other, said raised platforms form a raised frame frontwardly protruded from said housing and are symmetrical with respect to said centerline thereof.

4. The air mover, as recited in claim 3, wherein said housing further comprises a plurality of reinforcement ribs radially and integrally extended from said end panel to said surrounding wall of said first housing body for enhancing the rigidity of said end panel to support said motor thereat.

5. The air mover, as recited in claim 4, wherein said air stream generator further comprises a control panel supported at said raised frame and operatively linked to said motor to control an operation of said motor.

6. The air mover, as recited in claim 5, wherein each of said first and second housing bodies further comprises a handle body upwardly protruded from said surrounding wall at said inner side of each of said first and second housing bodies, such that when said first and second housing bodies are coupled with each other, said handle bodies form a handle frame upwardly protruded from said housing and are symmetrical with respect to said centerline thereof.

7. The air mover, as recited in claim 6, wherein said housing further comprises a first cable holder formed at an upper end of said handle frame and a second cable holder formed at a bottom end of said raised frame, wherein a connection cable is operatively linked to said control panel and is extended within said handle frame to a rear side of said housing such that said connection cable is retracted and wound between said first and second cable holders for minimizing a number of turns of said connection cable.

8. The air mover, as recited in claim 7, wherein said housing further comprises a perforated and cover detachably coupled at said outer side of said second side housing to cover said side opening thereof, and two air filters detachably coupled with said end panel and said and cover respectively via a tool-less engaging unit.

9. The air mover, as recited in claim 8, wherein said tool-less engaging unit has a locking channel coaxially formed at a center of each of said end panel and said end cover, and comprises a plug-and-lock member coaxially protruded from a center of each of said air filters, such that when said plug-and-lock members are detachably inserted into said locking channels respectively, said air filters are securely coupled at said outer sides of said housing respectively.

10. The air mover, as recited in claim 9, further comprising an adjustable stand for adjustably retaining said housing on a ground surface, wherein said adjustable stand comprises two elastic members spaced from at a bottom side of said housing and a folding stand pivotally coupled between said elastic members to pivotally fold between a horizontal position that said folding stand is rearwardly folded to said bottom side of said housing to enable bottom side of said housing being horizontal rested on said ground surface via said elastic members, and a tilted position that said folding stand is frontwardly folded away from said bottom side of said housing to enable said housing being slantedly rested on said ground surface via said folding stand.

11. The air mover, as recited in claim 10, wherein each of said elastic members has a holding surface for slidably retaining said folding stand in position and a stopper edge for holding said folding stand at said tilted position.

12. The air mover, as recited in claim 11, wherein said housing further comprises an air guider mounted at said air exit in a screw-less manner, wherein said air guider is embedded within an inner wall of said air exit when said first and second housing bodies coupled with each other.

13. The air mover, as recited in claim 3, wherein said air stream generator further comprises a control panel supported at said raised frame and operatively linked to said motor to control an operation of said motor.

14. The air mover, as recited in claim 13, wherein each of said first and second housing bodies further comprises a handle body upwardly protruded from said surrounding wall at said inner side of each of said first and second housing bodies, such that when said first and second housing bodies are coupled with each other, said handle bodies form a handle frame upwardly protruded from said housing and are symmetrical with respect to said centerline thereof.

15. The air mover, as recited in claim 14, wherein said housing further comprises a first cable holder formed at an upper end of said handle frame and a second cable holder formed at a bottom end of said raised frame, wherein a connection cable is operatively linked to said control panel and is extended within said handle frame to a rear side of said housing such that said connection cable is retracted and wound between said first and second cable holders for minimizing a number of turns of said connection cable.

* * * * *